United States Patent [19]

Fapiano et al.

[11] 4,274,273

[45] Jun. 23, 1981

[54] TEMPERATURE CONTROL IN HOT STRIP MILL

[75] Inventors: Donald J. Fapiano, Salem; Michael A. Smith, Roanoke, both of Va.

[73] Assignee: General Electric Company, Salem, Va.

[21] Appl. No.: 81,563

[22] Filed: Oct. 3, 1979

[51] Int. Cl.[3] ..... B21B 37/10; B21B 37/08; B21B 45/02

[52] U.S. Cl. ..... 72/13; 72/201

[58] Field of Search ..... 72/8, 10, 11, 13, 200, 72/201, 202; 266/113

[56] References Cited

U.S. PATENT DOCUMENTS

| | | | |
|---|---|---|---|
| 3,514,984 | 6/1970 | Cook | 72/13 X |
| 3,613,418 | 10/1971 | Nara et al. | 266/113 X |
| 3,628,358 | 12/1971 | Fapiano et al. | 72/8 |
| 3,779,054 | 12/1973 | Greenberger | 72/13 |
| 3,905,216 | 9/1975 | Hinrichsen | 72/201 |

FOREIGN PATENT DOCUMENTS

| | | | |
|---|---|---|---|
| 2446009 | 4/1975 | Fed. Rep. of Germany | 72/13 |
| 51-57660 | 5/1976 | Japan | 72/13 |
| 52-26224 | 7/1977 | Japan | 72/202 |

*Primary Examiner*—Ervin M. Combs
*Attorney, Agent, or Firm*—Arnold E. Renner

[57] ABSTRACT

A method for controlling the temperature of a workpiece in a hot strip mill includes calculating temperature changes of the strip at each mill stand location by determining changes in workpiece deformation resistance and correlating the changes in deformation resistance to changes in temperature. Error corrections are made for changes in rolling speed. The calculated temperature change at each mill stand is used to control water sprays positioned adjacent the mill stands. A temperature sensor is placed downstream of the last mill stand to act as a check on the desired delivery temperature of the workpiece. Temperature discrepancies from the temperature sensor are fed upstream to modify temperature corrections.

17 Claims, 5 Drawing Figures

TEMPERATURE CONTROL IN HOT STRIP MILL

CROSS-REFERENCE TO RELATED PATENTS

STRIP TEMPERATURE CONTROL SYSTEM, U.S. Pat. No. 3,905,216, issued Sept. 16, 1975 to E. N. Hinrichsen, here the "Runout Table Cooling Patent," the disclosure of which is incorporated by reference.

METHOD OF REVISING WORKPIECE TEMPERATURE ESTIMATES OR MEASUREMENTS USING WORKPIECE DEFORMATION BEHAVIOR, U.S. Pat. No. 3,628,358, issued Dec. 21, 1971 to D. J. Fapiano and A. S. Norton, Jr., here the "Temperature Calculation Patent," the disclosure of which is incorporated by reference.

BACKGROUND OF THE INVENTION

1. Field of the Invention

The present invention relates to the rolling of metal strips and, more particularly, to a technique for accurately controlling the temperature of a strip during the rolling process.

2. Description of the Prior Art

Sheet metal is produced by rolling slabs, bars or other relatively massive workpieces into elongate, thin strips. Although finish rolling often is done under room temperature conditions, the initial reduction of the workpiece from its bulk form is done at elevated temperatures in a facility known as a hot strip mill. In a hot strip mill the workpieces are heated in a reheat furnace to a temperature of around 2200 degrees Fahrenheit (°F.). The reason the workpieces are heated to such an elevated temperature is that the temperature of the workpiece influences the resistance to deformation of the workpiece. That is, a hot workpiece has a lower resistance to deformation than a cold workpiece and, accordingly, requires less roll force before it will be deformed by a given amount than a cold workpiece of similar composition and dimensions. In short, deforming a workpiece maintained at an elevated temperature may be done easier and faster than one maintained at a lower temperature.

The temperature at which the rolling process is commenced is not maintained throughout the mill. As the strip passes from one stand of rolls to another, heat losses caused by radiation and/or strip-to-roll conduction reduce the temperature of the strip to about 1500° F. to 1700° F., depending in part upon the thickness of the strip. After the strip leaves the last mill stand, it must be cooled further prior to being coiled and banded. The Runout Table Cooling Patent describes a particularly effective technique for reducing the temperature of a hot rolled strip between the time the strip leaves the last mill stand and before it is coiled.

In addition to the obvious goal in a hot strip mill of reducing a workpiece to a desired finish thickness, it also is important that the temperature drop from the initial elevated temperature to the finish temperature and to the temperature at which the strip is coiled be controlled as much as possible. As explained more completely in the Runout Table Cooling Patent, metallurgical properties of hot rolled strip metal are dependent not only upon the composition of the metal, but also upon the temperatures at which the final thickness reductions take place, the temperature at which the strip is coiled, and the rate at which the temperature of the strip changes during the final cooling process. When steel is the material under consideration, the final thickness reductions normally take place above 1600° F. and the strip is cooled on the runout tables to approximately 1200° F. While finishing and coiling temperatures are of principal importance, the temperature at reductions preceding the final reduction may be important in achieving certain metallurgical properties. For these metallurgical grades, it is desirable to maintain constant temperature not only at the final rolling stands but at one or more of the preceding rolling stands. A secondary consideration relates to the control of strip flatness during rolling. In modern, computer-controlled hot strip mills, one objective of the reduction schedule is to assign reductions in successive stands which will produce roll separating forces and associated strip crowns which are compatible with good flatness. These strategies are well known and are described, for example, in "Automatic Shape Control—Hoogoven's 88—In. Hot Strip Mill" by F. Hollander and A. G. Reinen, *Iron and Steel Engineer,* April, 1976. Strip flatness control will be improved where the rolling force at each stand is maintained more nearly constant throughout the strip length. This would of course require that intermediate as well as final rolling temperatures be held essentially constant. In short, by maintaining temperature at all stands essentially constant in the presence of variations in incoming strip temperature and variations in rolling speed, both metallurgical qualities and strip flatness can be enhanced.

A significant problem in maintaining the temperature of a metal strip at desired predetermined levels relates to "skid marks." Skid marks are sections of a strip at temperatures significantly below the average temperature of the strip, often by as much as 100° F. Skid marks are caused because the workpieces are pushed through the reheat furnace on skids or other supports. The skids are water cooled and, thus, are at a lower temperature than the temperature of the rest of the furnace. Accordingly, small sections of the workpiece in direct contact with the skids will not be heated as much as other portions of the workpiece. The temperature deviation of the areas of the workpiece in contact with the skids is carried throughout the remainder of the rolling process, even though the great initial temperature deviation may be largely attenuated by the time the rolling process is complete. In any event, the existence of the skid marks causes a temperature variance in the strip along the length of the strip. This has made it difficult to control the temperature of all portions of the strip with a great deal of accuracy.

Another important consideration influencing the temperature of the strip is that of rolling speed. Modern high speed rolling mills thread the initial portion of the workpiece through the mill and coiler at a relatively low speed and accelerate rapidly to higher speeds where most of the rolling is done. All of the heat transfer phenomena in the rolling process are time dependent. Strip temperature loss through radiation and conduction to the work rolls is reduced at higher speeds, while energy input to the strip may be slightly increased due to strain-rate related increases in deformation resistance. At the same time, strip temperature on entering the finishing train may be decreasing due to radiation loss. Additionally, the cooling effect of interstand sprays is dependent upon strip speed not only because of the reduced cooling time at higher speeds, but also because of interaction of the closely spaced sprays comprising a group due to incomplete recovery of surface temperature on entering successive spray regions. These considerable variations make it very difficult to predict with any degree of accuracy the temperature which the strip will attain as it passes through the various mill stands.

On mills not equipped with interstand cooling sprays, control of strip finishing temperature has been achieved by adjustments to the finishing speed. The necessary adjustment has, in some cases, been precalculated to exactly compensate for the variation in temperature of the strip entering the first rolling stand. The temperature achieved in this manner can then be sensed by means of a pyrometer located immediately downstream of the last mill stand. If the temperature exiting the last mill stand is too high, the mill can be slowed down; if the temperature is too low, the mill can be accelerated. A major disadvantage with this method is that the maximum speed and, therefore, the production rate are determined by the temperature of the incoming strip. A second disadvantage is that the correction technique is very slow and large portions of the strip may be finished at incorrect temperature.

The potentially most effective technique to control the temperature of a strip as it is being rolled is to provide a number of individually controllable water sprays between adjacent mill stands. If the sprays are positioned above and below the strip and across the width of the strip, effective cooling of the strip can be accomplished. Consequently, higher rolling speeds are made possible and the temperature increases caused by the higher rolling speeds can be corrected through the use of water sprays.

The single most important problem with the water spray approach has been in properly sensing the temperature of the strip and thereafter controlling operation of the water sprays. Although a pyrometer positioned downstream of the last mill stand has been very effective as a monitoring device, presently available pyrometers and other temperature sensors have not been sufficiently accurate to permit a reliable indication of interstand strip temperature. Another consideration is that of transport lag, that is, the problem of sensing the temperature of the strip at one downstream location, providing an upstream temperature correction, and having to wait for the results of the temperature correction to become known to the downstream temperature sensor. Because of the stand spacing and total elongation between the first interstand spray and the downstream pyrometer, an error or a correction in strip temperature at the first interstand spray may not be evident until 300 or 400 feet of strip have passed the interstand spray location.

In an attempt to overcome the foregoing problems associated with water spray control, various prior art proposals have been made, all without much success. One of these proposals has been to calculate in advance a temperature profile for a strip of different thicknesses, rolling speeds, and so forth. As the mill accelerates to its desired rolling speed, water sprays are commenced at predetermined intervals. The sprays are activated first near the last mill stand and are activated sequentially in an upstream direction. During mill deceleration, the sprays are deactivated in the reverse sequence. A fundamental problem with this approach is that most of the cooling takes place toward the final mill stands. This means that the temperature corrections tend to be concentrated toward the end of the rolling process rather than distributed through the rolling train where they actually occur. This changes the temperatures at which intermediate reductions occur, and, as a result, also changes the rolling forces associated with these earlier reductions. These changes may adversely affect both metallurgical properties and strip flatness. A second, practical problem is that errors in the predictive calculations, due for example to changes in cooling spray effectiveness, are not known unless sensed by a downstream pyrometer, which is subject to the previously described delay problems.

Other "predictive" approaches are possible, but they all suffer from the drawback of not being able to accurately account for all situations which will be encountered during operation of a hot strip mill. In short, predictive approaches have serious shortcomings, but no completely acceptable adaptive control system exists either.

SUMMARY OF THE INVENTION

The present invention overcomes the foregoing and other drawbacks of prior art temperature control proposals and provides an effective, controllable technique to roll metal workieces in a hot strip mill at desired temperature levels. Essentially, the invention comprises calculating at each mill stand, as a function of strip deformation resistance, the difference between strip temperature in a first strip region and strip temperatures at successively later strip regions and, in response to the calculated temperature differences, controlling the operation of water sprays located immediately downstream of each mill stand so as to hold essentially constant the temperature at which strip enters the subsequent stand. A pyrometer located on the exit side of the last mill stand provides a control on the absolute temperature of the strip by continuously updating the temperature references, or "lock-on" values, of one or more of the later mill stands.

In a preferred embodiment, the temperature change at each mill stand is calculated by determining the change in deformation resistance of the workpiece from measurements of roll separating force and correlating the deformation resistance change to the temperature change of the workpiece. More specifically, a load cell included as part of each mill stand senses (a) a first roll separating force at or near the strip head end and (b) changes of roll separating force from the first roll separating force. Entry and delivery thicknesses at each mill stand are calculated from the load cell force readings, the roll positions, and the mill modulus according to a known method for controlling strip gauge. Deformation resistance is determined from the ratio of force to reduction at each mill stand. Pre-stored empirical data are used to correlate the change in deformation resistance with changes in temperature. The empirical data are determined in advance for different rolling conditions. Corrections for the change in the deformation resistance resulting from changes in strain rate are included.

By continuously monitoring the load cells, in effect a continuous reading on strip temperature change is obtained without the use of interstand pyrometers. Where hydraulic cylinders are used to adjust roll gap, hydraulic pressure may be used as an indication of roll separating force, instead of load cells. The temperature control system automatically accomodates variations in spray effectiveness due to water pressure, water temperature, nozzle conditions, and other causes. A more uniform temperature trajectory through successive rolling stands is made possible by feeding required temperature corrections from each mill stand to water sprays immediately downstream of that mill stand.

DESCRIPTION OF THE PREFERRED EMBODIMENT

Figure 1:
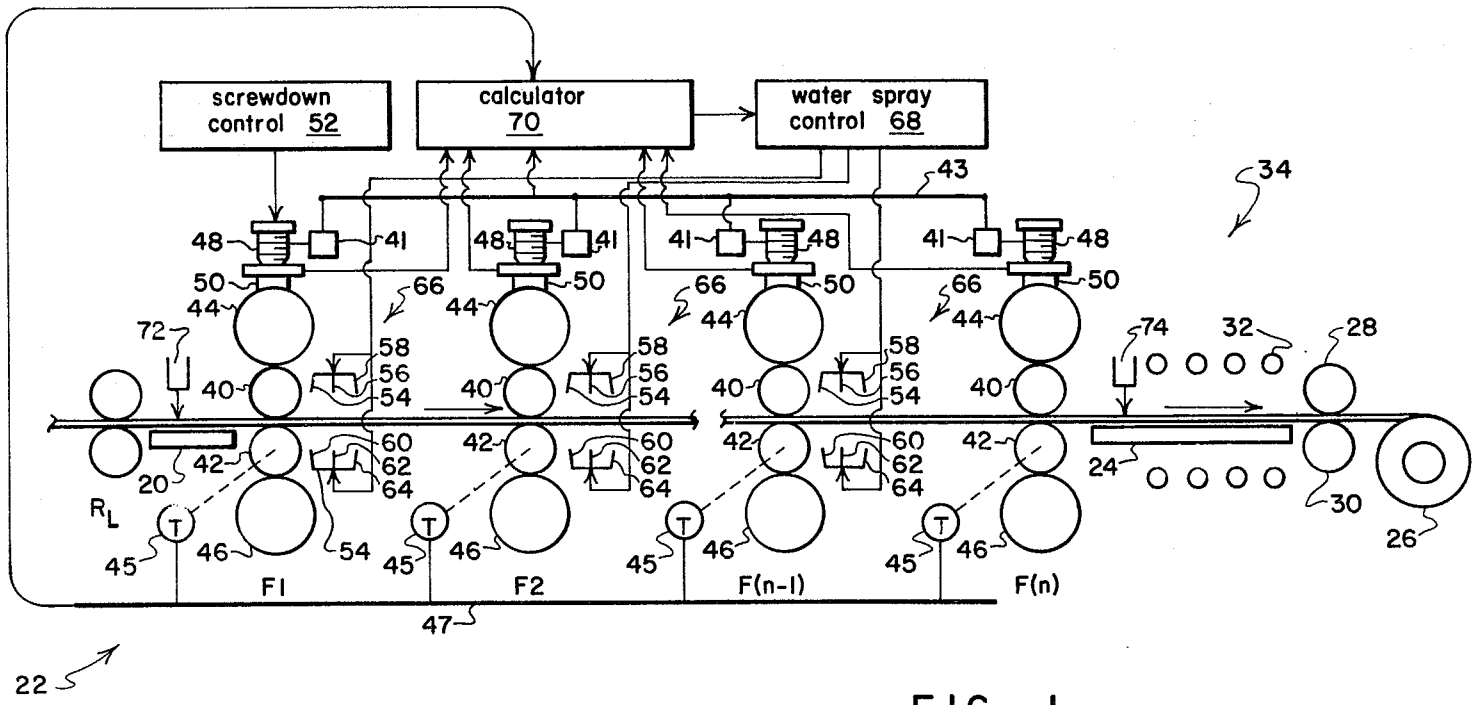
FIG. 1 is a schematic view of a temperature control system according to the invention incorporated in a hot strip mill.

In a hot strip mill, the initial reductions of the thickness of a metal slab are taken in a set of tandem mill stands known collectively as a roughing train. FIG. 1 shows in greatly simplified form the last stand $R_L$ of a roughing train along with other components in a hot strip mill. As the slab emerges from the stand $R_L$, it moves across a mill table 20 toward a finishing train 22 consisting of mill stands F1, F2, F(n-1), and F(n) arranged in tandem. In a typical hot strip mill, seven mill stands are provided in the finishing train 22. The final reductions in thickness are taken in the finishing train 22 to produce a metal strip which may be 1,000 or more feet in length, two to seven feet in width, and 0.040 to 0.50 inches in thickness.

During its passage through the roughing train and the finishing train 22, the strip gradually is cooled from its initial temperature of about 2200° F. By the time the strip reaches stand F(n) it has cooled to around 1500°-1700° F. As the strip emerges from the last stand F(n) of the finishing train 22, it traverses a cooling or runout table 24 before being wound by a coiler 26. Strip tension during the coiling operation may be maintained by a pair of pinch rolls 28, 30 located at the coiler end of the runout table 24. A number of individually controlled water spray means (hereinafter simply sprays), one of which is designated by the numeral 32, are located above and below the runout table 24 to form a cooling zone 34 in which the strip is cooled to a proper temperature for coiling, usually on the range of 850°-1,300° F. Reference is made to the Runout Table Cooling Patent for a description of a preferred technique for cooling the strip.

Each stand in the finishing train 22 includes an upper work roll 40 and a lower work roll 42. Upper and lower backup rolls 44, 46 are pressed against the upper and lower work rolls 40, 42, respectively, during a rolling operation to prevent excessive distortion of the work rolls 40, 42. This configuration is known as a four-high mill. Each mill stand includes roll-adjusting screws 48 to regulate the opening between the upper and lower work rolls 40, 42. The roll opening may be determined as a function of screw position. One appropriate means for accomplishing this function is illustrated in FIG. 1 by shaft encoders 41 which provide feedback signals to bus 43. A load cell 50 is positioned intermediate the roll-adjusting screws 48 and the upper backup rolls 40 to provide an indication of the compressive force exerted between the upper and lower work rolls 40, 42. Variations in rolling force exerted by a strip passing between the rolls 40, 42 will be sensed by the load cell 50. The work rolls 40, 42 are positioned by a screw-down control system 52 which controls the position of the roll-adjusting screws 48. The thickness of the strip after entry is maintained essentially constant by the automatic gauge control system in a manner well known in the art, and the thickness of the strip as it exits the stand can be determined from unloaded roll opening, roll separating force and mill modulus in accordance with known practices; e.g., U.S. Pat. No. 2,726,541, issued Dec. 13, 1955. The work rolls 40 and 42 are driven by suitable motors (not shown) the speeds of which are sensed by appropriate sensing means such as tachometers 45 which provide speed feedback signals to a bus 47.

In the preferred embodiment, individually controllable water sprays 54, 56, 58 are located above the strip and are positioned intermediate adjacent mill stands F1, F2, . . . F(n). Individually controllable water sprays 60, 62, 64 are located below the strip and are positioned intermediate adjacent mill stands F1, F2, . . . F(n). Taken together, the individual sprays 54, 56, 58, 60, 62, 64 may be referred to collectively in appropriate contexts as cooling sprays 66. A water spray control system 68 is connected to the sprays 66 to control operation of the sprays 66. (An alternate to the use of individually controlled discrete sprays would be the proportional control of spray flow. The important function here desired is the variation in amount of coolant.) A calculator 70 receives inputs from the load cells 50, encoders 41 (bus 43) and tachometers 45 (bus 47) and, after appropriate analysis as will be described subsequently, sends a control signal to the water spray control 68. A pyrometer 72 is positioned upstream of the first mill stand F1. A second pyrometer 74 is positioned a short distance downstream of the last mill stand F(n). The pyrometers 72, 74 sense the temperature of the strip as the strip enters and exits the finishing train 22.

During the rolling process, the strip loses heat through radiation, through conduction to the work rolls, through convection to the air, and it is heated by the energy required in deformation. The first three phenomena are directly dependent on time, while the deformation energy is slightly dependent upon deformation rate. Thus the temperature change experienced by the strip is related to the speed at which the mill is run and the degree of reduction to which the strip is subjected. Under modern rolling conditions, the strip may pass through the finishing train 22 at such a speed that the temperature of the strip exiting the last mill stand F(n) may be sufficiently high that the cooling capacity of the cooling zone 34 may be exceeded. The cooling sprays 66 thus provide a capability to cool the strip sufficiently during its passage through the finishing train 22 that maximum rolling speed may be attained and yet the cooling capacity of the cooling zone 34 will not be exceeded. A significant concern, however, is that the supplementary cooling be applied in a manner which introduces the least possible disturbance to the temperatures at which all finishing reductions occur. Desirably, changes in strip temperature will be corrected in the region where they occur.

Figure 2:
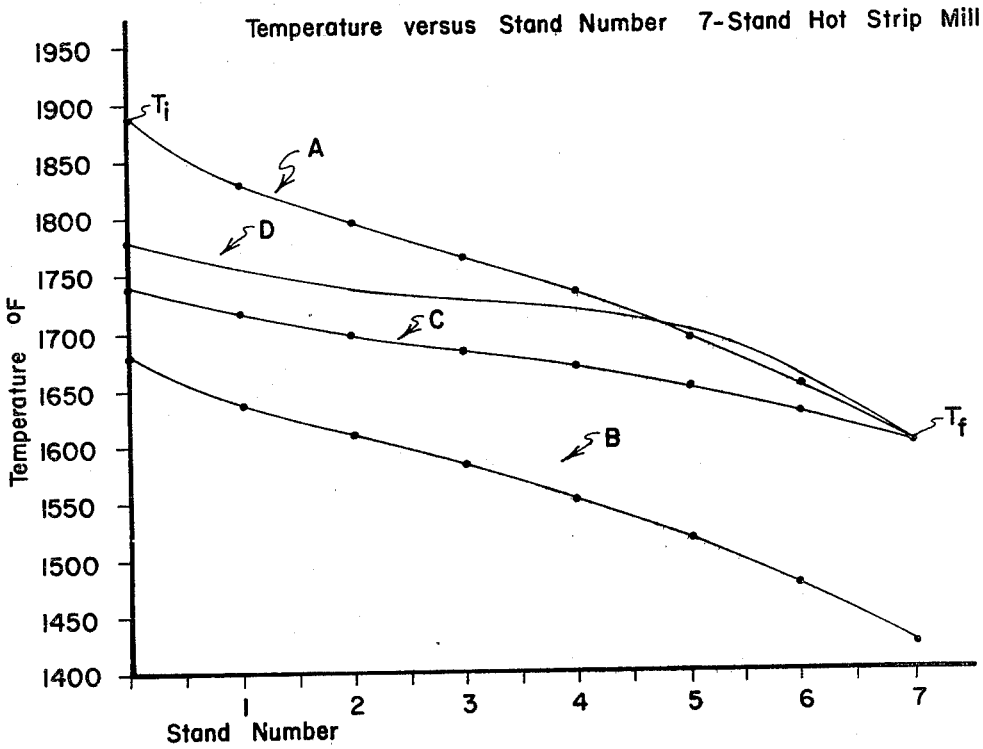
FIG. 2 is a plot of temperature versus mill stand location, curves being plotted for different locations along the length of the strip and for heating effects due to rolling speed.

The foregoing considerations can be understood more clearly by referring to FIG. 2 which assumes a seven stand mill. Curve A is a plot of temperature versus mill stand location for the head end of a strip as it passes through the finishing train 22. The initial temperature $T_i$ is that sensed by the upstream pyrometer 72. The final temperature $T_f$ is that sensed by the downstream pyrometer 74. Target temperatures have been identified for predetermined temperatures which the head end of the strip desirably will attain at mill stands F5, F6 and F7. Curve A accordingly defines a desired temperature profile of the head end of a strip. Curve B is the temperature profile of the tail end of a strip run at low mill speed and without use of the water sprays 66. During most of its processing through the finishing train 22, the tail end of the strip will be at a temperature less than desired.

Curve C is the temperature profile of the tail end of a strip rolled with just sufficient finishing train acceleration to achieve a constant F7 exit temperature. Curve C represents modern practice on mills not equipped with interstand cooling sprays. The maximum attainable rolling speed is limited at all times by the target delivery temperature $T_f$ and the initial strip temperature $T_i$. Curve D is a temperature profile of the tail end of a strip processed under higher rolling speeds with the use of water sprays. The preferred use of water sprays would be one in which Curve D is made to conform as closely as possible to curve A. For the conditions illustrated, appropriate use of cooling sprays beginning with those immediately downstream of F4 could be used to restore strip temperatures at F5 through F7 to their initial or head end values. For some products, it is desirable to "bias" the spray selection strategy; that is, one or more of the group of sprays in each interstand location can be turned on upon strip entry, where there is sufficient heat capacity in the strip to achieve the target final temperature for the strip head end. Then, as strip entry temperature drops approaching the strip tail end, sprays in the early interstand spaces would be turned off in order to restore strip temperatures to their head end values while sprays in the later interstand spaces would be turned on to compensate for temperature increases there.

The most important factor in maintaining a constant strip temperature "profile" as it passes through the finishing train 22 is accurate measurement of strip temperature changes in the region of the interstand sprays, where these changes must be corrected. Even with temperature variations due to skid marks, if an accurate indication of temperature change can be had, then the individual water sprays can be controlled to eliminate the temperature variation as soon as it appears. The pyrometers 72, 74 placed upstream of the first mill stand F1 and downstream of the last mill stand F(n) may provide acceptable continuously available temperature information. Pyrometers are not presently practical between mill stands because temperature measurements in these locations are influenced adversely by steam, spray, and standing water deposited on the strip by the water sprays 66. Furthermore, the strip surface is subject to abrupt "chilling" in its passage through the work rolls 40, 42 rendering inaccurate temperature measurements made before adequate recovery time has elapsed. The downstream pyrometer 74, while producing acceptable temperature measurements, provides only the aggregate temperature change and no information concerning how this change is distributed over the finishing train 22. Furthermore, as stated earlier, this information is available only after the region of strip being measured may be 300 or 400 feet past the point at which the temperature correction should have been made.

The foregoing problems are overcome by the present invention in which temperature changes at each mill stand are determined by interpreting the output of the load cells 50. It has been found that changes in roll separating force associated with the strip thickness reductions can be correlated to changes in temperature of the strip, provided the change in deformation resistance associated with changes in rolling speed are taken into account. Reference is made to the Temperature Calculation Patent for a description of a technique for relating force to temperature. In that patent, corrections for changes in rolling speed were not considered since large changes in speed were not typical in the applications for which the invention was originally made. In modern hot strip mills, however, speed changes within the coil may exceed 2:1, requiring adjustments for the associated strain rate effects before accurate temperature inferences can be drawn.

When a temperature change has been observed in the foregoing manner at a particular mill stand, the temperature change can be used in a feed-forward strategy to control the water sprays 66 immediately downstream of that mill stand. For example, if a temperature deviation exists at mill stand F1, the water sprays 54, 56, etc. immediately downstream of the mill stand F1 can be activated to attempt to correct the temperature deviation. This process can be carried out for each of the other mill stands. Any temperature deviations not corrected between mill stands F1 and F2 will be sensed by the temperature calculation at mill stand F2 and individual water sprays 54, 56, etc. downstream of the mill stand F2 can be activated as needed in an attempt to correct the temperature deviation. As the strip progresses through the finishing train 22, increasingly effective temperature correction will be attained in a uniform manner so that a particular desired temperature at mill stand F(n) will be reached.

If a desired high threading speed will produce higher than desired strip temperature, certain of the water sprays 66 can be activated in advance of the initial temperature determinations. Use of pre-activated sprays has other advantages as mentioned earlier. Deactivation of previously activated sprays as the colder tail end approaches the early stands, while activating additional sprays in the later stands, may permit closer conformance to the desired temperature profile. Additionally, pre-activation permits response to skid marks near the strip head end by deactivating sprays as the colder skid mark regions pass through the early stands.

An important advantage of the foregoing technique is that the need for a transport lag compensation largely is avoided, provided the system can function fast enough. Even though presently existing rolling mill speeds are quite high (on the order of 3000 feet/minute), water spray reaction time is sufficiently fast (0.50–0.75 seconds) that temperature correction action can be taken immediately downstream of each mill stand without excessive error. In effect, each mill stand temperature computation is independent of upstream temperature computations and temperature corrections, and acts to hold temperatures in its region of control as constant as possible.

The described technique is a so-called lock-on system in that the temperature computation and the water spray activation is based on temperature deviations, rather than on absolute temperature measurements. The upstream pyrometer 72 permits initial set-up calculations to achieve the desired head end temperature and desired temperature profile. The downstream pyrometer 74 permits absolute temperature to be monitored and further corrective actions to be applied. For example, if the downstream pyrometer 74 senses that the temperature of the strip is, say, 20° F. too high, an error signal can be fed upstream to the temperature calculation at mill stand F(n−1). Additional water spray immediately downstream of mill stand F(n−1) then could be activated. If the temperature deviation were great enough that the spray capacity downstream of mill stand F(n−1) were exhausted, then the "excess" temperature deviation signal could be sent upstream to the preceding mill stand F(n−2). Additional water spray immediately downstream of mill stand F(n−2) then could be activated. In this manner, a closed loop control system on the absolute temperature of the strip can be attained.

Alternative methods for applying the corrections from the downstream pyrometer could increase the number of upstream stands to which the correction is applied. This reduces the disturbance to the temperature "profile" resulting from this feedback action, while increasing the time for all corrective actions to become evident at the pyrometer 74.

The use of feedback from a downstream sensor, whether the pyrometer 74 or the temperature change sensed by the mill stand F(n) to control an upstream spray, may introduce the need for compensation for transport lag. Transport lag compensation technique already are known, and principally require a knowledge of the speed of the strip, the distances between temperature sensing locations and water spray locations, and the time available in which corrective action can be taken. Because most of the corrective action taken according to the present invention is by feed-forward strategy, any transport lag compensation problems are minimized greatly because they occur only at the extreme downstream end of the finishing train 22.

In order to estimate a temperature change at a given mill stand, forces, thickness reductions, and rolling speeds are determined for successive sampling time intervals. Strain rate, $\dot{e}$, is defined as the rate at which strain occurs, given in per-unit per second. After initial threading of the strip into a mill stand and after a brief time delay, on the order of 1 to 2 seconds, to allow the mill to recover from impact speed drop and to permit tension transients to subside, the ratio of roll force to reduction ($F/\Delta h$) is developed and stored as a lock-on value of deformation resistance. A lock-on value for strain rate $\dot{e}$ also is developed. The strip temperature change $\Delta T$ at lock-on is, by definition, zero. For a scanning interval (i), the following equations can be used to determine the estimated strip temperature change:

$$\Delta T = \frac{\{[(F/\Delta h)_i/(F/\Delta h)_o] - 1\} - \{[\ln(\dot{e}_i/\dot{e}_o)] \times \partial\left[\frac{(\partial F/\partial h)_i}{(\partial F/\partial h)_o}\right] / \partial(\ln \dot{e})\}}{\partial\left[\frac{(\partial F/\partial h)_i}{(\partial F/\partial h)_o} / \partial T\right]} - \Delta T_{FB} \quad (1)$$

Where

F=force sensed by the load cells 50;

$\Delta h$=reduction in strip thickness;

$\dot{e}$=rate at which strip thickness reduction occurs;

$\Delta T_{FB}$=temperature correction from the pyrometer 74;

0=conditions existing at a given starting point; and, i=conditions existing after a predetermined time or strip length interval.

$$\dot{e} = V\sqrt{\frac{1}{R\,\Delta h}}\,\ln\frac{h_1}{h_2} \quad (2)$$

Where

V=work roll peripheral velocity;

R=work roll radius $h_1$=thickness of strip entering rolls;

$h_2$=thickness of strip exiting rolls; and, $\Delta h$=thickness reduction=$(h_1-h_2)$ The first bracketed term in the numerator of equation (1) represents the per-unit change in deformation resistance during a scanning interval (i). The second bracketed term in the numerator of equation (1) represents that portion of the per unit deformation resistance change which is attributable to changes in rolling speed. The strain rate $\dot{e}$ is calculated from equation (2). The denominator of equation (1) represents the change in relative deformation resistance with temperature, and $\Delta T_{FB}$ represents corrections to the lock-on temperature value based upon subsequent measurement by the pyrometer 74. Equation (1) uses the ratio of deformation resistance, $(F/\Delta h)_i/(F/\Delta h)_o$, which is necessary to give accurate results where the reduction, $\Delta h$, in a stand may change. Where gauge control holds reductions in each stand constant, a close approximation may be achieved by using the ratio of forces, $F_i/F_o$.

The effect of the cooling sprays 66 can be determined from the equation:

$$\Delta T_{sj} = K_j(T_s - T_w)/hv \quad (3)$$

Where j=identifying index of individual sprays comprising an interstand group;

$K_j$=a variable (usually empirically derived) dependent upon the axial extent and flow rate of the water spray; the specific heat, density, and coefficient of convection of the strip; and the number of activated sprays in the group;

$T_s$=calculated temperature of the strip;

$T_w$=temperature of the water;

h=the thickness of the strip; and, v=the velocity of the strip.

The decision to activate or deactivate a water spray downstream of a given mill stand is made by comparing the most recent calculation of temperature change $\Delta T$ for a particular zone, j, with the sum of the temperature drops, $\Delta T_{sj}$, due to presently actuated sprays. A dead-band is provided to prevent excessive cycling of the water sprays. Control of the water sprays is determined as follows:

(4) If $$\Delta T \geqq \sum_{j=o}^{j=n} \Delta T_{sj} + D,$$

turn on spray if available.

(5) If $$\Delta T < \sum_{j=o}^{j=n} \Delta T_{sj} - D,$$

turn off spray.

Where n=the number of individually controllable water sprays between adjacent mill stands; and, D=a predetermined temperature increment, corresponding approximately to one-half the temperature drop from one spray.

Figure 3:
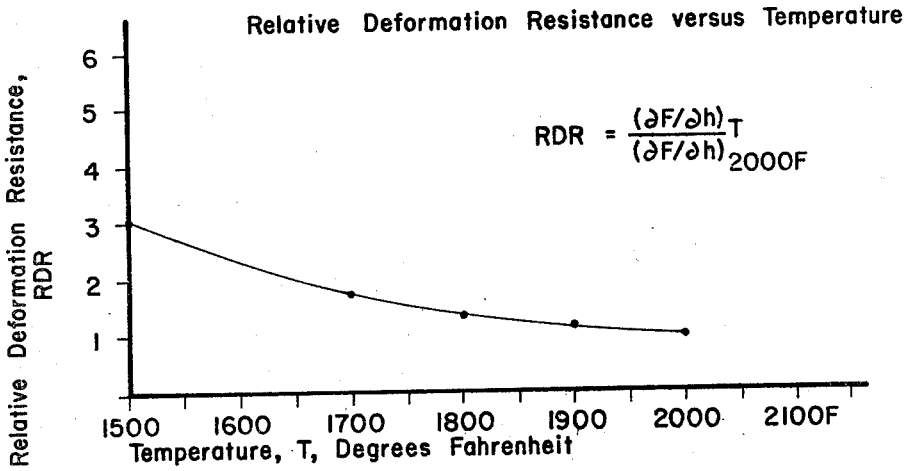
FIG. 3 is a plot of relative resistance to deformation with respect to temperature for one grade of workpiece material.

Certain of the factors of equations (1) and (3) may be generated off-line, and stored to be called upon during actual on-line processing of a strip. The graph of FIG. 3 represents predetermined relationships between temperature and relative deformation resistance for typical steel materials. In this FIGURE, deformation resistance is shown relative to that at 2000° F., for one material grade. The point of reference is immaterial, since the curves are used only to determine the per unit change in deformation resistance per degree of temperature difference. At 1650° F., for example, this change would be approximately -0.0025 per unit per degree F.; that is, the deformation resistance at 1651° F. would be about 0.25% less than the deformation resistance at 1650° F.

Figure 4:
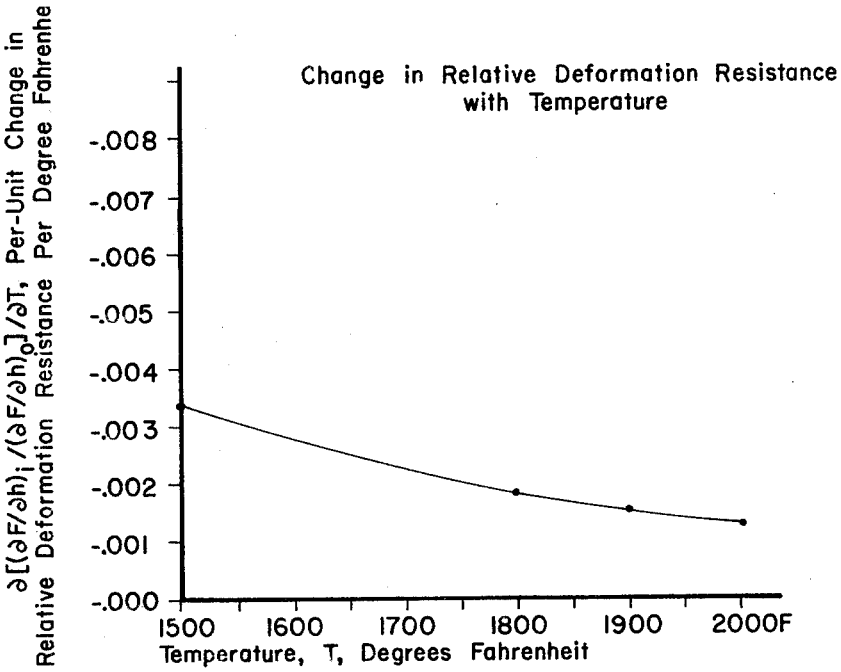
FIG. 4 is a plot of per unit change in relative deformation resistance per degree F., with respect to temperature; and, FIG. 5 is a plot of per unit change in relative deformation resistance with respect to strain rate for one grade of workpiece material.

Another way of relating per unit deformation resistance change to temperature change is shown in FIG. 4. FIG. 4 is developed by dividing the slope at each point along the curve of FIG. 3 by the relative deformation resistance at that point. Again it is seen that deformation resistance at 1650° F. changes -0.25% per degree F. increase in temperature. Other representations may be used to yield mathematically equivalent results.

Figure 5:
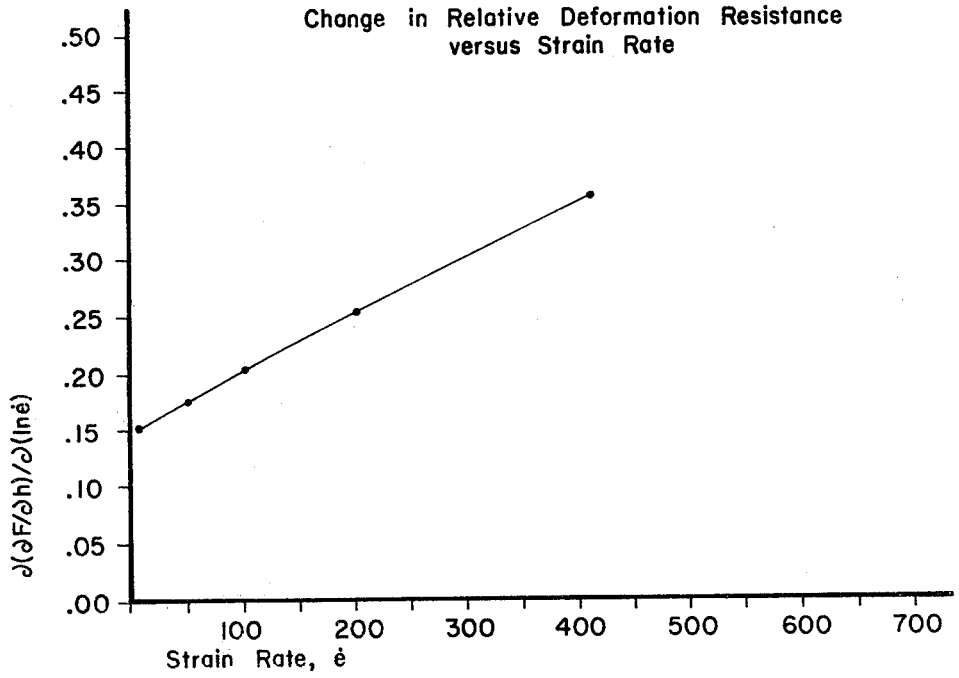

The graph of FIG. 5 represents, for various strain rates, the rate of change of relative deformation resistance with the natural logarithm of strain rate. The logarithm of strain rate is used simply because it provides a more linear relationship. FIG. 5 shows, for example, that for strain rates of approximately 100 per unit per second which are typical of hot strip finishing, a 10 percent change in rolling speed, and thus in strain rate, would produce an approximate 2 percent change in rolling force. This relationship, sometimes referred to as "strain-rate sensitivity" can be determined by either laboratory or production rolling mill tests. A family of such curves is generated for the actual operating conditions encountered during normal operation of a mill. Appropriate curves can be called upon, depending upon the type of material to be processed. The curves of FIGS. 3 and 4 are based on actual operating experience for a particular steel grade.

The effectiveness of force change as an indicator of temperature change varies over the rolling temperature range, requiring typically from 3° F. to 7° F. to produce a 1 percent force change. Since speed changes of only 10 percent may produce force changes of the same order, it is clearly necessary to correct for speed differences where they are significant. With proper care in force interpretation, it is practical to discern force changes of 1 percent or less, corresponding to temperature changes as small as 3° F. at some mill stands.

A consideration influencing the accuracy of the temperature determination is the presence of eccentricity in the backup rolls 44, 46. If the roll bodies are eccentric with respect to their journals, then the strip reduction will vary during the rotation of the backup rolls resulting in variation in the roll separating force. The effect of eccentricity on temperature determination can be minimized by employing a sampling period long enough to average force readings over one or more backup roll revolutions. In general, eccentricity is a potential problem only at the center stands of the finishing train 22. At the initial mill stands where the eccentricity is much smaller than the thickness reduction, the associated force variations are negligible. For example, an eccentricity at mill stand F1 of 0.002 inches typically will produce a force variation of 0.4 percent or less. At the delivery end of the finishing train 22, eccentricity as a percent of thickness reduction is large enough to be of concern, but the backup roll rotational rate is high enough to provide acceptable averaging during an interval of 1 or 2 seconds. At the intermediate mill stands, thickness reduction is perhaps 0.1 inches and rotational speed is still fairly low, perhaps ½ revolution per second. Here, the sampling intervals should be on the order of 2 or 3 seconds in order to provide acceptable eccentricity averaging. In general, a sampling interval of about 2 seconds also will be sufficient to reduce temperature variations in the strip due to skid marks while providing acceptable force averaging.

Some modern rolling mill systems employ band pass filter techniques to remove cyclic components in the sensed force due to roll eccentricity. Where these techniques are in use, shorter force scanning intervals and faster response may be practical.

Another consideration which must be taken into account is incoming thickness variations to the first mill stand F1. These variations, which may result from eccentricity in the roughing train or from skid marks which pass uncorrected through the roughing train, may cause force readings which might be interpreted as temperature changes. A solution is to reduce the temperature change estimates derived from the force changes, deliberately underestimating the required corrections at mill stand F1. After passing through mill stand F1, the incoming thickness variations will be attenuated sufficiently that temperature readings from mill stands F2 through F(n) can be employed without adjustment.

By employing the present invention, it is now possible to control quite accurately and without long delays the temperature of a strip as it passes through the finishing train 22. Because the temperature of the strip can be controlled quickly and accurately, the mill can be accelerated to the maximum permissible speed at faster accelerating rates than would otherwise be possible. Furthermore, the interstand cooling sprays can be used to correct local variations such as skid marks which otherwise would be impossible to correct using the feedback techniques of prior art. Maintenance of the planned temperature profile as well as the planned final temperature permits not only maximum production, but minimizes flatness variations and changes in metallurgical properties which would result from changes in the temperature and force "profile" through the finishing train.

Although the invention has been described in its preferred form with a certain degree of particularity, it will be understood that the present disclosure of the preferred embodiment has been made only by way of example and that numerous changes may be resorted to without departure from the true spirit and scope of the invention as hereinafter claimed. It is intended that the patent shall cover, by suitable expression in the appended claims, whatever features of patentable novelty exist in the invention disclosed.

What is claimed is:

1. In a hot strip rolling mill including at least one mill stand having opposed work rolls where a metal workpiece is reduced in thickness by passing the workpiece between said opposed work rolls, said mill stand having means to sense the force applied to the workpiece and at least one controllable water spray means positioned adjacent thereto, a method for controlling the temperature of the workpiece during the rolling process, comprising the steps of:

(a) sensing the force applied to the workpiece at said mill stand during a plurality of successive time intervals;

(b) determining the reduction in workpiece thickness at said mill stand during each of said intervals;

(c) developing the deformation resistance of said workpiece, during each of said intervals, from the ratio of the force applied to the workpiece to the reduction in workpiece thickness;

(d) determining an apparent temperature change in the workpiece, if any, as a function of the differences between the initial and each successively developed deformation resistance; and, (e) controlling the application of a water spray from said spray means onto said workpiece as a function of said apparent temperature change to thereby control the temperature of said workpiece.

2. The invention in accordance with claim 1 wherein the rolling mill has at least an upstream stand and a downstream stand and the water spray means is located between the two stands wherein each of the steps of sensing the force, determining the reduction, developing the deformation resistance and determining the apparent temperature change are performed with respect to the upstream stand.

3. The method of claim 1, comprising the additional steps of:

(a) sensing rolling speed during said plurality of time intervals;

(b) determining the change, if any, upon deformation resistance resulting from any change in rolling speed; and, (c) correcting the calculated temperature change to account for the change in deformation resistance due to changes in rolling speed.

4. The method of claim 1 wherein said controllable water spray means is comprised of a plurality of individually controllable elements and wherein said step of controlling the application of said water spray consists of:

(a) calculating the anticipated change in workpiece temperature which will result from a change in the operational state of individual spray elements;

(b) summing the anticipated changes in workpiece temperature for all presently operating spray elements to develop a cumulative anticipated change in workpiece temperature due to said operating spray elements;

(c) comparing said cumulative change with said apparent temperature change in the workpiece to generate a difference value; and, (d) varying the operational state of individual spray elements in response to said difference value.

5. The method of claim 4 further including the additional step of rendering operational at least one spray element before passing the workpiece between the opposed work rolls.

6. The method of claim 1, comprising the additional steps of:

(a) sensing the temperature of the workpiece as said workpiece exits said stand;

(b) comparing said sensed temperature with a predetermined desired workpiece temperature to develop a temperature error value; and, (c) modifying said apparent temperature change in the workpiece as a function of said temperature error.

7. The method of claim 1 wherein the interval over which force is sensed is great enough that the effect of eccentricity variations in the rolls is made negligible.

8. In a hot strip rolling mill having at least two mill stands each having opposed work rolls where a metal workpiece is reduced in thickness by passing the workpiece between said opposed work rolls, each stand including means to hold the workpiece thickness delivered therefrom at a predetermined value and means to sense the force applied to the workpiece, said mill including at least one controllable water spray means positioned between two adjacent stands, a method of controlling the temperature of the workpiece during the rolling process comprising the steps of:

(a) sensing the force applied to the workpiece at each mill stand during a plurality of successive time intervals;

(b) determining an apparent temperature change in the workpiece as a function of the differences between the initial and each successively sensed force; and, (c) controlling the application of a water spray from said spray means onto said workpiece as a function of said apparent temperature change to thereby control the temperature of said workpiece.

9. The method of claim 8 comprising the additional steps of:

(a) sensing the rolling speed at each of said mill stands during said plurality of time intervals;

(b) determining the change, if any, in the force resulting from any change in rolling speed; and, (c) correcting the calculated temperature change to account for the change in force due to changes in rolling speed.

10. The method of claim 8 wherein said controllable water spray means is comprised of a plurality of individually controllable elements and wherein said step of controlling the application of said water spray consists of:

(a) calculating the anticipated change in workpiece temperature which will result from a change in the operational state of individual spray elements;

(b) summing the anticipated changes in workpiece temperature for all presently operating spray elements to develop a cumulative anticipated change in workpiece temperature due to said operating spray elements;

(c) comparing said cumulative change with said apparent temperature change in the workpiece to generate a difference value; and, (d) varying the operational state of individual spray elements in response to said difference value.

11. The method of claim 10 further including the additional step of rendering operational at least one spray element before passing the workpiece between the opposed work rolls.

12. The method of claim 8, comprising the additional steps of:

(a) sensing the temperature of the workpiece as said workpiece exits at least one stand;

(b) comparing said sensed temperature with a predetermined desired workpiece temperature to develop a temperature error value; and, (c) modifying said apparent temperature change in the workpiece as a function of said temperature error value.

13. The method of claim 8 wherein the interval over which force is sensed is great enough that the effect of eccentricity variations in the rolls is made negligible.

14. The method of claim 1 wherein the apparent temperature change (ΔT) is determined from the relationship:

$$\Delta T = \frac{[(F/\Delta h)_i/(F/\Delta h)_o] - 1}{\partial\left[\frac{(\partial F/\partial h)_i}{(\partial F/\partial h)_o}\right]/\partial T}$$

where

F=force applied to the workpiece;

Δh=reduction in workpiece thickness;

0=conditions existing at a given point in time; and, i=conditions existing after a predetermined time or workpiece length interval.

15. The method of claim 3 wherein the apparent temperature change (ΔT) is determined from the relationship:

$$\Delta T = \frac{\{[(F/\Delta h)_i/(F/\Delta h)_o] - 1\} - \{[\ln(\dot{e}_i/\dot{e}_o) \times \partial\left[\frac{(\partial F/\partial h)_i}{(\partial F/\partial h)_o}\right]/\partial(\ln\dot{e})\}}{\partial\left[\frac{(\partial F/\partial h)_i}{(\partial F/\partial h)_o}/\partial T\right]}$$

where

F=force applied to the workpiece;

Δh=reduction in workpiece thickness;

ė=rate at which workpiece thickness reduction occurs;

o=conditions existing at a given point in time; and, i=conditions existing after a predetermined time or workpiece length interval.

16. The method of claim 6 wherein the apparent temperature change (ΔT) is determined from the relationship:

$$\Delta T = \frac{\{[(F/\Delta h)_i/(F/\Delta h)_o] - 1\} - \{[\ln(\dot{e}_i/\dot{e}_o)] \times \partial\left[\frac{(\partial F/\partial h)_i}{(\partial F/\partial h)_o}\right]/\partial(\ln\dot{e})\}}{\partial\left[\frac{(\partial F/\partial h)_i}{(\partial F/\partial h)_o}/\partial T\right]} - \Delta T_{FB}$$

where f=force applied to the workpiece;

Δh=reduction in workpiece thickness;

ė=rate at which workpiece thickness reduction occurs;

$\Delta T_{FB}$=temperature correction from a separate sensor;

o=conditions existing at a given point in time; and, i=conditions existing after a predetermined time or workpiece length interval.

17. The method of claim 4 wherein the comparison of the apparent temperature change (ΔT) and the cumulative anticipated change in workpiece temperature $$\left(\sum_{j=o}^{j=n} \Delta T_{sj}\right)$$

is in accordance with the relationships:

if $$\Delta T \geqq \sum_{j=o}^{j=n} \Delta T_{sj} + D,$$

turn on spray if available; and, if $$\Delta T < \sum_{j=o}^{j=n} \Delta T_{sj} - D,$$

turn off spray;

where $$\Delta T_{sj} = \frac{K_j(T_s - T_w)}{hv};$$

and, $K_j$=a variable dependent upon the axial extent and flow rate of the water spray and the specific heat, density, and coefficient of convention of the workpiece, and the number of activated elements in the spray;

$\Delta T_{sj}$=anticipated change in workpiece temperature due to spray j;

$T_s$=workpiece temperature;

$T_w$=temperature of the water;

h=thickness of the workpiece;

v=velocity of the workpiece;

n=the number of individually controllable water spray elements between adjacent mill stands; and, D=a predetermined temperature increment, approximately equal to one-half the anticipated workpiece temperature change due to one operating spray element.

* * * * *